US006982727B2

(12) United States Patent
Baer et al.

(10) Patent No.: US 6,982,727 B2
(45) Date of Patent: Jan. 3, 2006

(54) SYSTEM AND METHOD FOR PROVIDING GRAPHICS USING GRAPHICAL ENGINE

(75) Inventors: David A. Baer, San Jose, CA (US); Darren Neuman, San Jose, CA (US)

(73) Assignee: Broadcom Corporation, Irvine, CA (US)

( * ) Notice: Subject to any disclaimer, the term of this patent is extended or adjusted under 35 U.S.C. 154(b) by 279 days.

(21) Appl. No.: 10/201,017

(22) Filed: Jul. 23, 2002

(65) Prior Publication Data

US 2004/0017383 A1 Jan. 29, 2004

(51) Int. Cl.
*G09G 5/00* (2006.01)

(52) U.S. Cl. ..... 345/629; 345/632; 345/634; 345/638; 345/641

(58) Field of Classification Search ..... 345/501, 345/502, 601–605, 426, 629–641, 506, 562; 348/393.1, 441, 445
See application file for complete search history.

(56) References Cited

U.S. PATENT DOCUMENTS

| | | | | |
|---|---|---|---|---|
| 5,629,720 | A * | 5/1997 | Cherry et al. | 345/601 |
| 6,016,150 | A * | 1/2000 | Lengyel et al. | 345/426 |
| 6,157,415 | A * | 12/2000 | Glen | 348/599 |
| 6,311,204 | B1 * | 10/2001 | Mills | 345/502 |
| 6,380,945 | B1 | 4/2002 | MacInnis et al. | |

FOREIGN PATENT DOCUMENTS

WO WO 01/45426 6/2001

* cited by examiner

*Primary Examiner*—Matthew C. Bella
*Assistant Examiner*—Hau Nguyen
(74) *Attorney, Agent, or Firm*—McAndrews, Held & Malloy, Ltd.

(57) ABSTRACT

Systems and methods that provide graphics using a graphical engine are provided. In one example, a system may provide layered graphics in a video environment. The system may include a bus, a graphical engine and a graphical pipeline. The graphical engine may be coupled to the bus and may be adapted to composite a plurality of graphical layers into a composite graphical layer. The graphical engine may include a memory that stores the composite graphical layer. The graphical pipeline may be coupled to the bus and may be adapted to transport the composite graphical layer.

30 Claims, 6 Drawing Sheets

SYSTEM AND METHOD FOR PROVIDING GRAPHICS USING GRAPHICAL ENGINE

BACKGROUND OF THE INVENTION

A conventional system provides both real-time video and real-time layered graphics in a layered display. Each layer of the layered graphics is generated by its own separate graphical pipeline. The number of graphical layers that can overlay a position on the screen (e.g., a single video pixel) is therefore limited by the number of separate graphical pipelines that can be implemented in hardware.

The conventional system may suffer from one or more of the following disadvantages. For example, such a configuration uses a substantial amount of chip space since a graphical pipeline must be added for each desired graphical layer. The addition of more graphical pipelines also increases the cost of producing the chip.

Furthermore, a plurality of graphical pipelines in concurrent use may exceed the available bandwidth. Each graphical pipeline may have substantial bandwidth requirements, especially where each graphical pipeline is providing a full-screen, real-time graphical surface. However, a plurality of graphical pipelines each concurrently providing a respective full-screen, real-time graphical surface would overload a conventional system. For example, the real-time nature of the graphical demands may create a memory bottleneck, thereby resulting in a failure (e.g., visual and audio display defects due to insufficient memory access when needed). This bandwidth concern also may limit the number of graphical surfaces that may be displayed or the number of graphical pipelines that may be implemented concurrently. Such bandwidth concerns are further exacerbated when multiple video output streams (e.g., independent video output streams) are desired such as, for example, in a multiple video output set top box environment.

Further limitations and disadvantages of conventional and traditional approaches will become apparent to one of ordinary skill in the art by comparison of such systems with aspects of the present invention as set forth in the remainder of the present application with reference to the drawings.

BRIEF SUMMARY OF THE INVENTION

Aspects of the present invention may be found, for example, in systems and methods that provide graphics using a graphical engine. In one embodiment, the present invention may provide a system that provides layered graphics in a video environment. The system may include a bus, a graphical engine and a graphical pipeline. The graphical engine may be coupled to the bus and may be adapted to composite a plurality of graphical layers into a composite graphical layer. The graphical engine may include a memory that stores the composite graphical layer. The graphical pipeline may be coupled to the bus and may be adapted to transport the composite graphical layer.

In another embodiment, the present invention may provide a system that provides a layered display that comprises a video surface and layered graphical surfaces. The system may include a graphical hardware engine that may be adapted to generate a composite graphic layer as a function of a plurality of graphic layers. The system may also include a graphical pipeline that may be coupled to the graphical engine. The graphical pipeline may be adapted to transport the composite graphic layer to a display.

In yet another embodiment, the present invention may provide a method that provides a composite display comprising a video layer and graphical layers. The method may include the steps of compositing a plurality of graphical layers into a composite graphical layer in a graphical engine; and combining a real-time video layer with a non-real-time graphical layer, the non-real-time graphical layer comprising the composite graphical layer.

These and other features and advantages of the present invention may be appreciated from a review of the following detailed description of the present invention, along with the accompanying figures in which like reference numerals refer to like parts throughout.

DETAILED DESCRIPTION OF THE INVENTION

Figure 1:
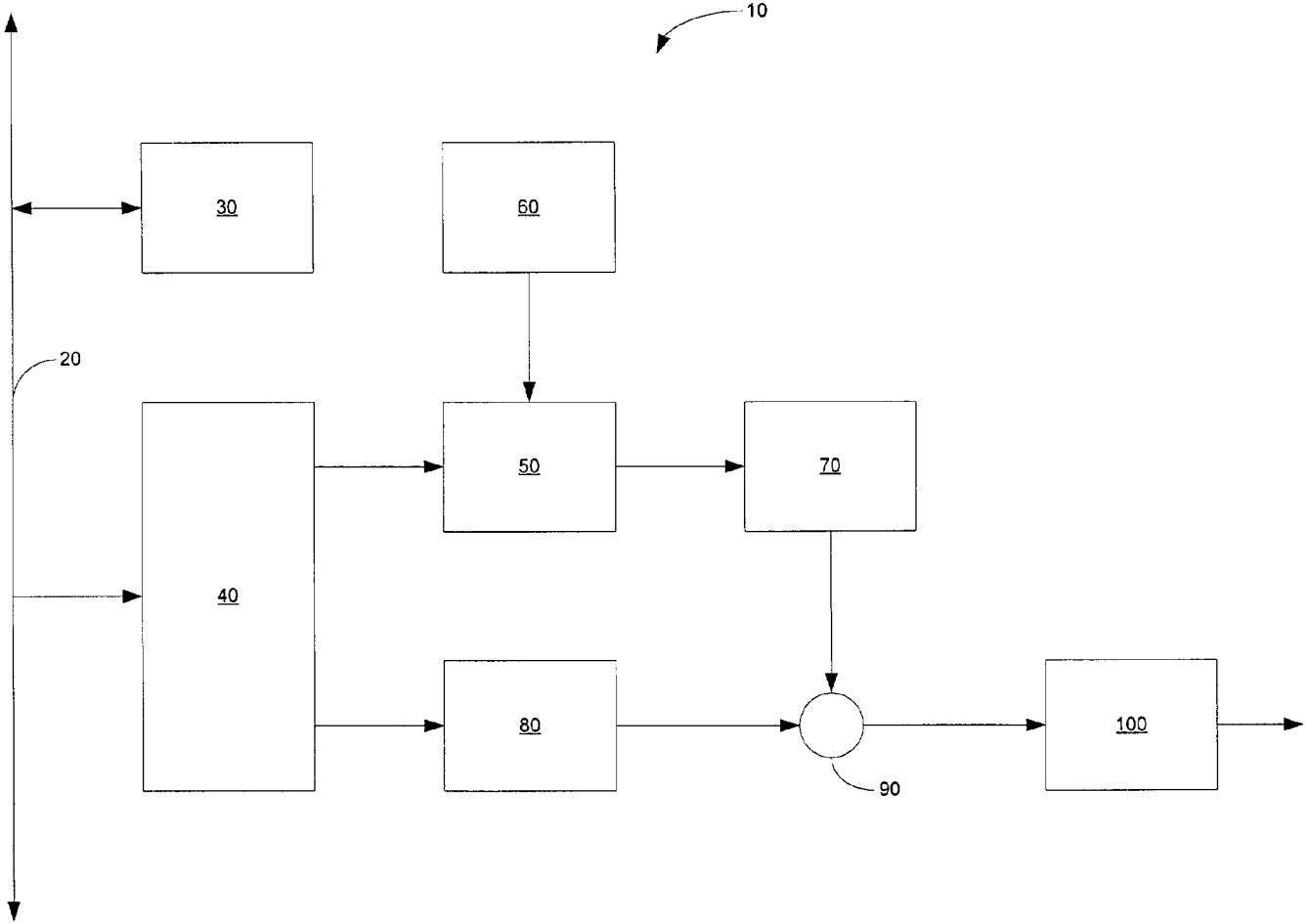
FIG. 1 shows a first embodiment of a graphical pipeline architecture according to the present invention.

FIG. 1 shows a first embodiment of a graphical pipeline architecture according to the present invention. The graphical pipeline architecture 10 may include, for example, a bus (e.g., a memory bus, a network bus, etc.) 20, a graphical engine 30, a window controller 40, a format converter 50, a color lookup table (CLUT) 60, an aspect ratio converter 70, a cursor CLUT 80, a blender 90 and an anti-flutter filter 100. The graphical engine 30 may be coupled to the bus 20 and may be adapted to be in two-way communication with the bus 20. The window controller 40 may also be coupled to the bus 20 and may be adapted to be in at least one-way communication with the bus 20. The window controller 40 may further be coupled to the format converter 50 and to the cursor CLUT 80. The format converter 50 may further be coupled to the CLUT 60 and to the aspect ratio converter 70. The aspect ratio converter 70 and the cursor CLUT 80 may additionally be coupled to the blender 90 which, in turn, may be coupled to the anti-flutter filter 100.

The graphical engine 30 may include, for example, a two-dimensional blitter (e.g., a block transfer engine, a bit block transfer engine, a bit level transaction engine, etc.) In one example, the blitter may be adapted to perform any of the conventional blitter operations known to one of ordinary skill in the art. In another example, the blitter may be adapted, for example, to perform scaling, blending and rastering. The blitter may scale up or down a particular graphic object or at least a portion of a graphic layer. The blitter may also provide an alpha blend or a degree of transparency in the graphics. The blitter may also provide a raster operation such as, for example, any logical operations (e.g., AND, XOR, OR, etc.) between two graphical surfaces as is used, for example, in a screen door blend. In one example, the blitter may not have a direct display capability. The graphical engine 30 may include a memory such as, for example, a frame buffer. For example, the graphical engine 30 may be adapted to receive multiple video streams via, for example, the bus 20 and to composite them into a single graphics layer stored, for example, in the frame buffer. Since the single graphics layer is a composite, it may be displayed once.

Figure 2:
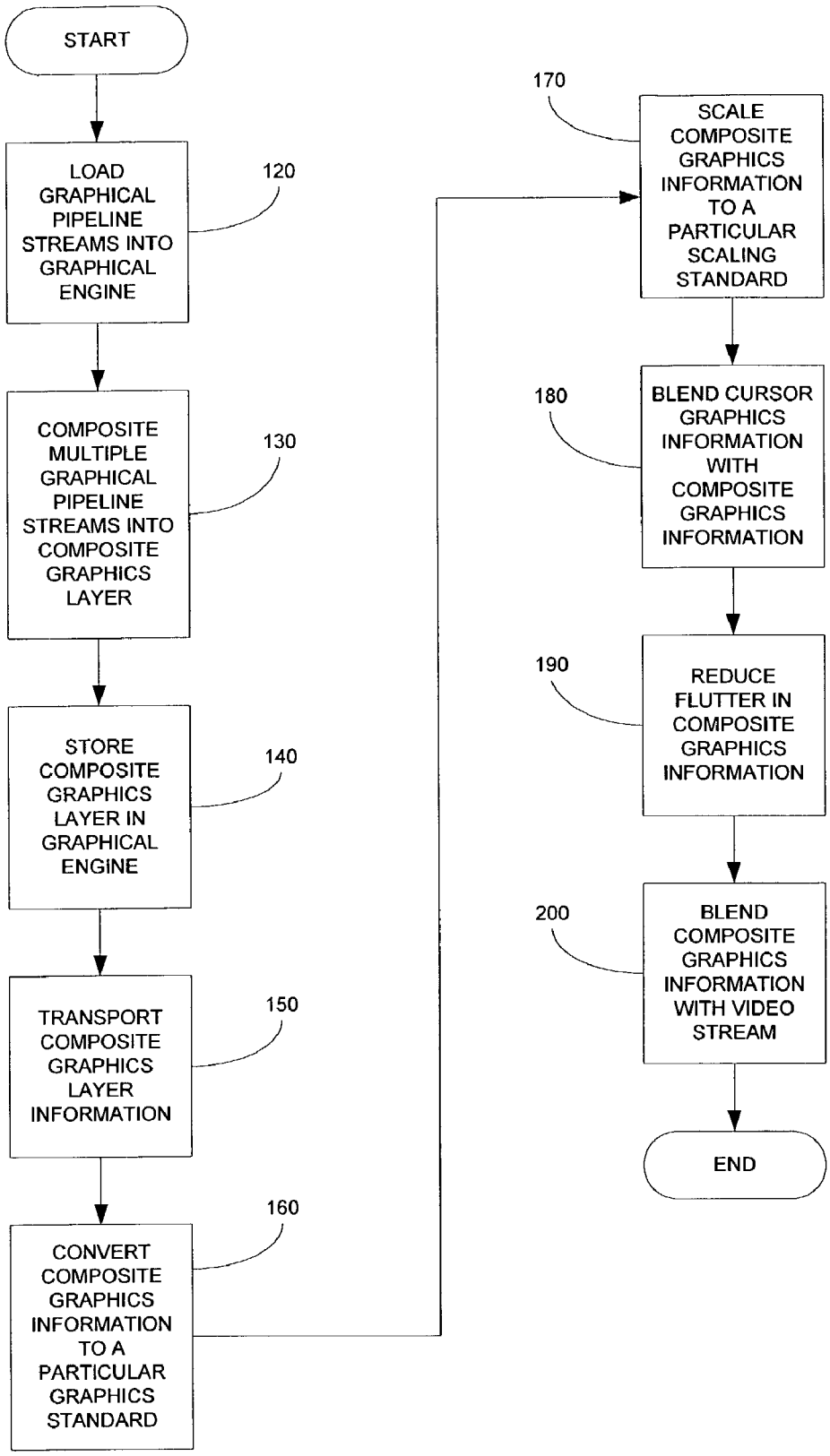
FIG. 2 shows a flowchart illustrating an embodiment of a process that provides a composite graphics layer using the first embodiment of the graphical pipeline architecture according to the present invention.

FIG. 2 shows a flowchart illustrating an embodiment of a process that provides a composite graphics layer using the first embodiment of the graphical pipeline architecture according to the present invention. In step 120, the graphical engine 30 may load, via the bus 20, one or more graphical pipeline streams into its memory. Each of the graphical pipeline streams may provide, for example, a respective graphics layer. In step 130, the graphical engine 30 may composite the loaded graphical pipeline streams into a single graphics layer which, in step 140, may be stored, for example, in the frame buffer of the graphical engine 30. Thus, the graphical engine 30 may provide, for example, sorting and blending of the graphics layers in forming the composite graphics layer. In addition, the graphical engine 30 may also provide special functionality such as, for example, video tunneling in portions of the composite graphics layer. The loading and compositing of multiple graphical pipeline streams may be background functions and may not be necessarily real-time functions. In one example, when sufficient bandwidth is available (e.g., temporarily available), the graphical engine 30 may access multiple graphical pipelines streams stored, for example, in a storage device (e.g., a memory, a hard drive, an optical drive, etc.) or in a network and may composite the multiple graphical pipeline streams into a single composite graphics layer which may be stored in the memory of the graphical engine 30. If sufficient bandwidth is not available for a substantial amount of time, the graphical engine 30 may use a previous composite graphics layer.

In step 150, the window controller 40 may access and transport information, via the bus 20, stored in the memory (e.g., the frame buffer) of the graphical engine 30 or elsewhere to the graphical pipeline (e.g., a single graphical pipeline) at the proper time. The information may be passed on to the format converter 50. The format converter 50 also may receive information from the CLUT 60. The CLUT 60 may be, for example, an 8-bit or smaller representation of colors in which each index may represent a different color. In step 160, the format converter 50 may convert the graphics to a particular graphics standard (e.g., 32-bit graphics). Thus, for example, low-bit graphics may be expanded to 32-bit graphics. In another example, the graphics may be converted to full 32-bit color per pixel graphics. The graphics may then be sent to the aspect ratio converter 70. In step 170, the aspect ratio converter 70 may provide scaling (e.g., horizontal scaling) according to a particular scaling standard. In one example, the aspect ratio converter 70 may scale the graphics for use in a 16×9 European standard display. In another example, the aspect ratio converter 70 may scale the graphics for use in a 4×3 American standard display. In another example, the aspect ratio converter 70 may account for square and non-square pixel formats. The scaled graphics information may then be sent to the blender 90.

Via the bus 20, for example, the window controller 40 may also provide cursor information to the cursor CLUT 80, which may provide cursor color. The cursor graphics information may then be sent to the blender 90. In step 180, the blender 90 may provide a weighted blend between the graphics information from the aspect ratio converter 70 and graphics information (e.g., cursor graphics information) from the cursor CLUT 80. In one example, the cursor graphics may always be placed on top of the graphics information from the aspect ratio converter 70. In another example, the cursor graphics may be slightly transparent. The blended graphics may then be sent to the anti-flutter filter 100.

In step 190, the anti-flutter filter 100 may reduce the flutter that may occur between the graphical display and the video display. For example, the anti-flutter filter 100 may process the blended graphics information (e.g., smooth the blended graphics). In one example, the anti-flutter filter 100 may provide a running weighted average using programmable coefficients over several lines of the blended graphics. For example, the anti-flutter filter 100 may smooth the edges of a graphical object by providing a weighted average over every 3 or 5 lines of the blended graphics. Thus, each line in the display may be replaced with a weighted average of the surrounding lines, thereby smoothing the graphics, particularly at the edges of graphics, and reducing the flutter. In step 200, the filtered graphical information may be sent to, for example, a video engine in which the filtered graphical information may be blended with the video stream for display with a video output.

The first embodiment of the present invention may provide one or more of the following advantages. For example, the first embodiment may avoid the memory bottlenecks that may occur when the available real-time bandwidth is insufficient. In one example, although the video and audio may be displayed in real time, the composite graphical layer provided by the graphical engine 30 may not necessarily be displayed in real time. Instead, the graphical layer may be formed from one or more graphical pipeline streams and may be displayed when sufficient bandwidth is available (e.g., during moments when the video and audio are not using too much of the available bandwidth). In addition, since a single graphical pipeline may be physically implemented because the single composite graphical layer may be stored in the graphical engine 30, less bandwidth may be used during the display process than, for example, when multiple real-time graphical pipelines are physically implemented with separate physical pipelines.

The first embodiment of the present invention may also save valuable chip space without substantially limiting the number of multiple graphical pipeline streams per display pixel. Since increasing the number of graphical pipeline streams may not necessarily increase the number of physical graphical pipelines implemented, there may not be a substantial space constraint as described with respect to the conventional system. Instead of adding a new physical graphical pipeline for each new graphical pipeline stream, the graphical engine 30 may load the additional graphical pipeline stream, for example, during a background operation via the bus 20 and may include the additional graphical pipeline stream in forming a single composite graphical layer which may then be stored in, for example, the frame buffer of the graphical engine 30.

Figure 3:
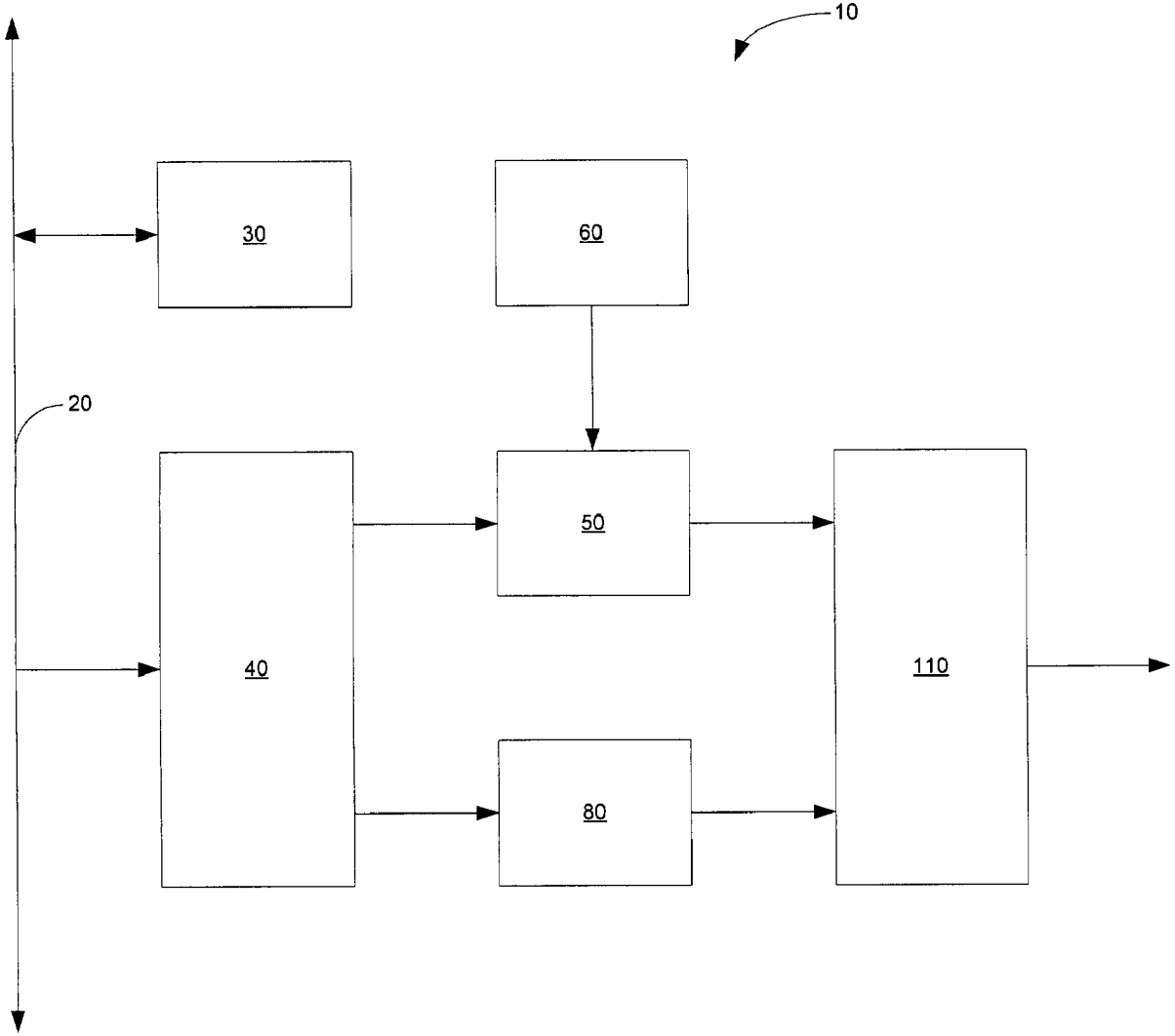
FIG. 3 shows a second embodiment of the graphical pipeline architecture according to the present invention.

FIG. 3 shows a second embodiment of a graphical pipeline architecture according to the present invention. The graphical pipeline architecture 10 may include, for example, the bus 20, the graphical engine 30, the window controller 40, the format converter 50, the CLUT 60, the cursor CLUT 80 and a compositor 110. The graphical engine 30 may be coupled to the bus 20 and may be adapted to be in two-way communication with the bus 20. The window controller 40 may also be coupled to the bus 20 and may be in at least one-way communication with the bus 20. The window controller 40 may further be coupled to the format converter 50 and to the cursor CLUT 80. The format converter 50 may also be coupled to the CLUT 60. The format converter 50 and the cursor CLUT 80 may further be coupled to the compositor 110. The compositor 110 may include, for example, a blender or a stacker.

The graphical engine 30 may be adapted to perform many of the operations described above. In addition, the graphical engine 30 may be adapted to provide aspect ratio conversion and to provide anti-flutter filtering. In one example, the graphical engine 30 may include, for example, a blitter that may be adapted to filter out or to reduce flutter. The blitter may include, for example, a scaling engine that may be adapted, not to change the scale of the graphical information, but to realize a filter function. The scaling engine may include an algorithm for scaling that may include a function with weighted coefficients that may be modified such that the scaling does not change and the desired filter function is realized.

Figure 4:
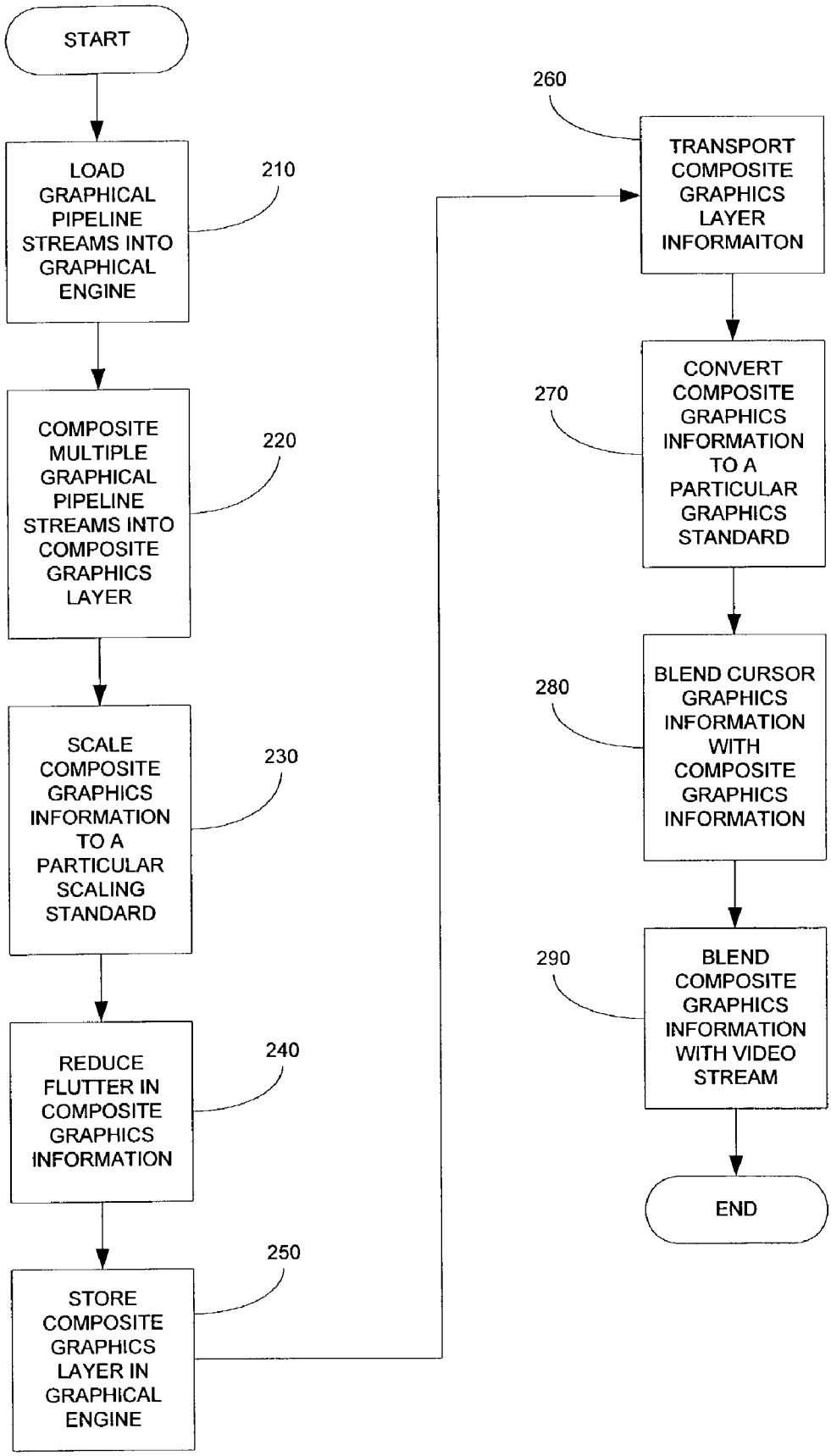
FIG. 4 shows a flowchart illustrating an embodiment of a process that provides a composite graphics layer using the second embodiment of the graphical pipeline architecture according to the present invention.

FIG. 4 shows a flowchart illustrating an embodiment of a process that provides a composite graphics layer using the second embodiment of the graphical pipeline architecture according to the present invention. In step 210, the graphical engine 30 may load, via the bus 20, one or more graphical pipeline streams into its memory. Each of the graphical pipeline streams may provide, for example, a respective graphical layer. In step 220, the graphical engine 30 may composite the loaded graphical pipeline streams into a single graphics layer which may be stored, for example, in the memory of the graphical engine 30. Thus, the graphical engine 30 may provide, for example, sorting and blending of the graphics layers in forming the composite graphics layer. In addition, the graphical engine 30 may also provide special functionality such as, for example, video tunneling in portions of the composite graphics layer.

In step 230, the graphical engine 30 may provide scaling (e.g., horizontal scaling) according to a particular scaling standard. In one example, the graphical engine 30 may perform the steps that would be performed by the aspect ratio converter 70. The graphical engine 30 may employ a scaling engine which may be part of a blitter. The blitter or the scaling engine may then scale a portion of or the entire composite graphics layer for use in a display in accordance with a particular scaling standard (e.g., a 4×3 American standard display, a 16×9 European standard display, etc.)

In step 240, the graphical engine 30 may reduce the flutter that may occur between the graphical display and the video display. For example, the graphical engine 30 may process the information stored in the composite graphics layer (e.g., smooth graphic objects in the composite graphics layer) to reduce flutter. In one example, the graphical engine 30 may provide a running weighted average using programmable coefficients over several lines of the composite graphics layer. For example, the graphical engine 30 may smooth the edges of a graphical object by providing a weighted average over every 3 or 5 lines of the composite graphics layer. Thus, each line in the display may be replaced with a weighted average of the surrounding lines, thereby smoothing the graphics, particularly at the edges of graphics, and reducing the flutter. The graphical engine 30 may also use a scaling engine which may be part of a blitter. By changing the programmable coefficients used by the scaling engine during a scaling algorithm, the scaling engine may be programmed to generate, for example, a weighted average over a plurality of lines in the composite graphics layer and to replace each line in the composite graphics layer with a corresponding weighted average line. Furthermore, the scaling engine may be programmed to provide a 1:1 scaling during the anti-flutter filter algorithm. In step 250, the composite graphics layer which may have been processed to reduce flutter may be stored in the memory (e.g., the frame buffer) of the graphical engine 30.

Steps 210–250, for example, may be performed in graphical engine 30 as background functions and may not necessarily be real-time functions. In one example, when sufficient bandwidth is available (e.g., temporarily available), the graphical engine 30 may access multiple graphical pipelines streams stored, for example, in a storage device (e.g., a memory, a hard drive, an optical drive, etc.) or in a network and may composite the multiple graphical pipeline streams into a single composite graphics layer which may be stored in the memory of the graphical engine 30. The information stored in the composite graphics layer may then be scaled for use in, for example, a 4×3 American display and processed to reduce flutter. The scaling and processing may be accomplished using a scaling engine of, for example, a blitter. If sufficient bandwidth is not available to the graphical engine 30 for a substantial amount of time, the graphical engine 30 may use a previous composite graphics layer for use in the display until sufficient bandwidth is available to update the memory (e.g., the frame buffer) of the graphical engine 30.

In step 260, the window controller 40 may access and transport information, via the bus 20, stored in the memory of the graphical engine 30 or elsewhere to the graphical pipeline (e.g., a single graphical pipeline) at the proper time. The information may be passed on to the format converter 50. The format converter 50 may also receive information from the CLUT 60. In step 270, the format converter 50 may convert the graphics to a particular graphics standard (e.g., 32-bit graphics). The converted graphics information may then be sent to the compositor 110. Via the bus 20, for example, the window controller 40 may also provide cursor information to the cursor CLUT 80, which may provide cursor color. The cursor graphics information may then be sent to the compositor 110. In step 280, the compositor 110 may provide a weighted blend between the graphics information from the format converter 50 and graphics information (e.g., cursor graphics information) from the cursor CLUT 80. In one example, the cursor graphics may always be placed on top of the graphics information from the aspect ratio converter 70. In another example, the cursor graphics may be slightly transparent. In step 290, the blended graphical information may be sent to, for example, a video engine in which the blended graphical information may be blended with the video stream for display.

The second embodiment of the graphical pipeline architecture according to the present invention may include one or more of the advantages described above with respect to the first embodiment of the graphical pipeline architecture according to the present invention. In addition, the second embodiment may include one or more of the following advantages. For example, the hardware may be reduced in the graphical pipeline system with the integration of the aspect ratio converter and the anti-flutter filter with the graphical engine 30.

In addition, the second embodiment may benefit from operational efficiencies by integrating, for example, the anti-flutter filter with the graphical engine 30. When the anti-flutter filter is in the graphical pipeline, it might not efficiently access graphical information. For example, in order to perform averaging over three lines, the anti-flutter filter may load the three lines into its memory or into a line buffer before performing, for example, the weighted averaging and replacing one of the lines with the three-line weighted average. When the next three lines are processed by the anti-flutter filter, it may have to discard possibly two of the lines in its line buffer in order to perform the three-line weighted average. This process may be bandwidth intensive particularly if the graphical pipeline is operating in real time. The second embodiment may provide more efficient use of its memory since it may have the graphical information stored in its frame buffer and, since the graphical engine 30 may not need to operate in real time, bandwidth issues may be minimized. Furthermore, since the graphical information is easily accessible and processed, the graphical engine 30 may be able to better filter the graphical information. For example, programmable multiple-line averaging schemes may easily be implemented or otherwise modified without substantially changing the hardware within the graphical pipeline system.

Figure 5:
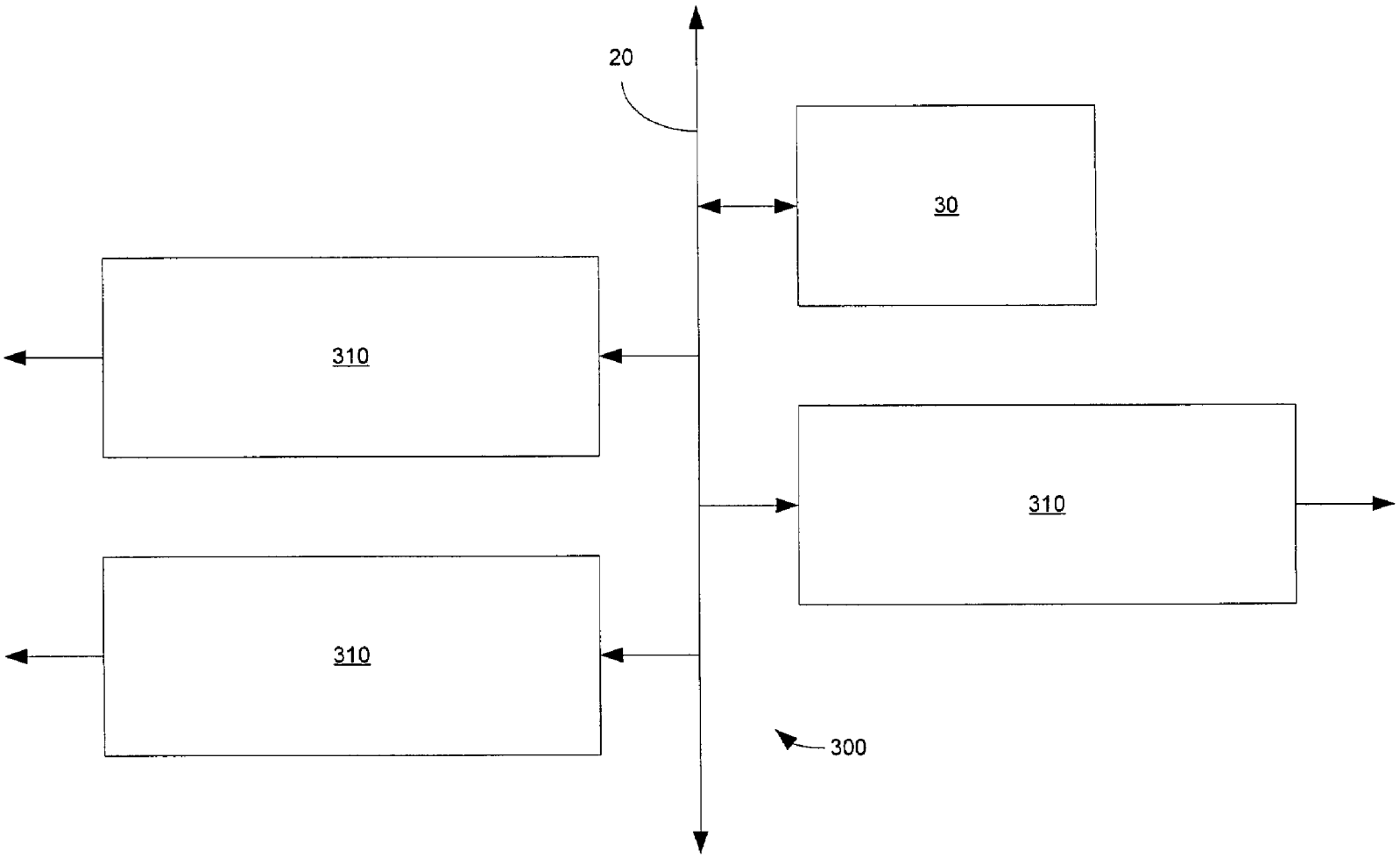
FIG. 5 shows an embodiment of a plurality of graphical pipeline architectures sharing a graphical engine according to the present invention.

FIG. 5 shows an embodiment of a plurality of graphical pipeline architectures sharing a graphical engine according to the present invention. The graphical system 300 may include, for example, the bus 20, the graphical engine 30, and a plurality of graphical pipeline systems 310. Although three graphical pipeline systems 310 are illustrated, the present invention may contemplate using more or less than three graphical pipeline systems 310. The graphical engine 30 may be coupled to the bus 20 and may be in two-way communication with the bus 20. The graphical pipeline systems 310 may each be coupled to the bus 20 and may each be in at least one-way communication with the bus 20. Each graphical pipeline system 310 may have an output that may be coupled to a respective independent video output stream. The graphical pipeline system 310 may include, for example, at least some of the components described above with respect to the first and the second embodiments of the graphical pipeline architecture 10 (except, for example, the bus 20 and the graphical engine 30). Since the graphical engine 30 may operate as a background engine when a sufficient amount of bandwidth is available, the graphical engine 30 including its memory may be shared by multiple graphical pipeline architectures corresponding to multiple independent video output streams. Time sharing between the graphical pipeline systems 310 may be easily managed where graphical displays are not generated in real time.

Figure 6:
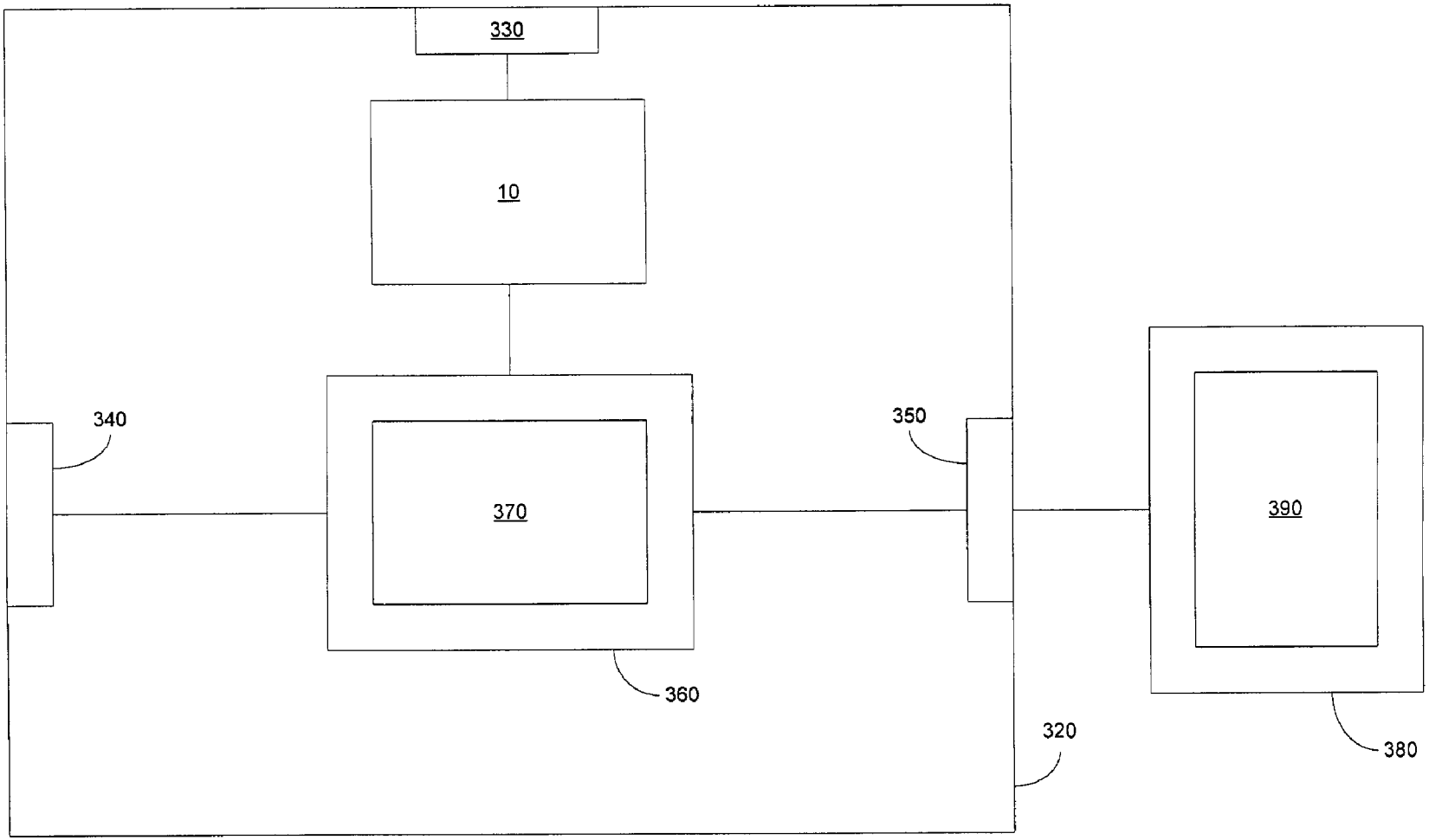
FIG. 6 shows an example of a graphical pipeline architecture in use in a set top box environment according to the present invention.

Although embodiments of the present invention may find many applications in a myriad of fields, FIG. 6 shows an example of the graphical pipeline architecture 10 in use in a set top box environment according to the present invention. The set top box 320 may include, for example, a graphical interface 330, a transport stream interface 340, a display interface 350, the graphical pipeline architecture 10, a data transport engine 360 which may include, for example, a video engine 370. The graphical interface 330 may be coupled to the graphical pipeline architecture 10 which, in turn, may be coupled to the data transport engine 360. In one example, the graphical pipeline architecture 10 may be coupled to the data transport engine 360 by sharing access to a bus (e.g., the bus 20). The transport stream interface 340 may be coupled to the data transport engine 360 which, in turn, may be coupled to the display interface 350. A display device 380, which may include a display engine 390, may be coupled to the set top box 320 via the display interface 350.

In operation, a transport stream containing a plurality of channels may enter the set top box 320 via the transport stream interface 340. The transport stream may then be passed on to the data transport engine 360 wherein the transport stream may be processed for display in the display device 380 using, for example, the video engine 370. The graphical interface 330 may receive graphical information or commands from a user device or from an external storage device (e.g., an external memory, a network, etc.) The graphical pipeline architecture 10 may access a storage device (not shown) either in the set top box 320 or, via the graphical interface 330, coupled to the set top box 320. The graphical pipeline architecture 10 may provide information about the composite graphics layer (as described above) to the data transport engine 360. In one example, the video engine 370 may blend the information about the composite graphics layer and the incoming processed transport stream. The blended information, including the composite graphics layer and the processed transport stream, may be passed to the display device 380 via the display interface 350. The display device 380 may then display the blended information via the display engine 390.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A system for providing layered graphics in a video environment, the system comprising:

a bus;

a graphical engine coupled to the bus, the graphics engine being adapted to receive information of a plurality of graphical layers over the bus and composite the plurality of graphical layers into a composite graphical layer, the graphical engine comprising a memory that stores the composite graphical layer;

a graphical pipeline coupled to the bus, the graphical pipeline being adapted to transport the composite graphical layer over the bus;

a cursor Color Look-Up Table (CLUT); and a compositor coupled to the cursor CLUT and the graphical pipeline, the compositor being adapted to composite contents of the cursor CLUT and contents of the graphical pipeline.

2. The system according to claim 1, wherein the graphical engine is not a real-time client.

3. The system according to claim 1, wherein the graphical engine is a hardware graphical engine.

4. The system according to claim 1, wherein the graphical engine comprises a blitter.

5. The system according to claim 1, wherein the graphical pipeline comprises at least one of: a window controller, a format conversion block and an aspect ratio conversion block.

6. The system according to claim 1, further comprising:

a window controller that is coupled to the bus, and a format conversion block that is coupled to the window controller.

7. The system according to claim 6, wherein the format conversion block is coupled to a color look-up table (CLUT).

8. The system according to claim 6, further comprising an aspect ratio conversion block that is coupled to the format conversion block.

9. The system according to claim 1, further comprising an anti-flutter filter coupled to the compositor.

10. The system according to claim 1, wherein the graphical engine is adapted to reduce flutter in a graphical display.

11. The system according to claim 1, wherein the graphical engine comprises a scaling engine that has been adapted to reduce flutter in the composite graphical layer.

12. The system according to claim 1, wherein the graphical engine is adapted to convert graphical information to a particular aspect ratio.

13. The system according to claim 4, wherein the blitter is adapted to provide video tunneling.

14. The system according to claim 1, wherein the graphical engine is adapted to provide at least one of: scaling, blending and rastering of graphical information.

15. The system according to claim 1, wherein the graphical engine is used in a set top box environment.

16. A system for providing layered graphics in a video environment, the system comprising:

a bus;

a graphical engine coupled to the bus, the graphical engine being adapted to receive information of a plurality of graphical layers over the bus and composite the plurality of graphical layers into a composite graphical layer, the graphical engine comprising a memory that stores the composite graphical layer;

a graphical pipeline coupled to the bus, the graphical pipeline being adapted to transport the composite graphical layer over the bus;

a Color Look-Up Table (CLUT); and a format conversion block coupled to the CLUT and the graphical pipeline.

17. The system according to claim 16, wherein the graphical engine is not a real-time client.

18. The system according to claim 16, wherein the graphical engine is a hardware graphical engine.

19. The system according to claim 16, wherein the graphical engine comprises a blitter.

20. The system according to claim 19, wherein the blitter is adapted to provide video tunneling.

21. The system according to claim 16, wherein the graphical pipeline comprises at least one of: a window controller, a format conversion block and an aspect ratio conversion block.

22. The system according to claim 16, further comprising:

a window controller that is coupled to the bus, and a format conversion block that is coupled to the window controller.

23. The system according to claim 22, further comprising an aspect ratio conversion block that is coupled to the format conversion block.

24. The system according to claim 16, further comprising:

a cursor Color Look-Up Table (CLUT); and a compositor coupled to the cursor CLUT and the graphical pipeline, the compositor being adapted to composite contents of the cursor CLUT and contents of the graphical pipeline.

25. The system according to claim 24, further comprising an anti-flutter filter coupled to the compositor.

26. The system according to claim 16, wherein the graphical engine is adapted to reduce flutter in a graphical display.

27. The system according to claim 16, wherein the graphical engine comprises a scaling engine that has been adapted to reduce flutter in the composite graphical layer.

28. The system according to claim 16, wherein the graphical engine is adapted to convert graphical information to a particular aspect ratio.

29. The system according to claim 16, wherein the graphical engine is adapted to provide at least one of: scaling, blending and rastering of graphical information.

30. The system according to claim 16, wherein the graphical engine is used in a set top box environment.

* * * * *